US007503405B2

(12) United States Patent
Hall et al.

(10) Patent No.: US 7,503,405 B2
(45) Date of Patent: Mar. 17, 2009

(54) ROTARY VALVE FOR STEERING A DRILL STRING

(76) Inventors: David R. Hall, 2185 S. Larsen Pkwy., Provo, UT (US) 84606; Tyson J. Wilde, 2185 S. Larsen Pkwy., Provo, UT (US) 84606; Carla Hedengren, 2185 S. Larsen Pkwy., Provo, UT (US) 84606

( * ) Notice: Subject to any disclaimer, the term of this patent is extended or adjusted under 35 U.S.C. 154(b) by 70 days.

(21) Appl. No.: 11/737,034

(22) Filed: Apr. 18, 2007

(65) Prior Publication Data

US 2007/0221409 A1 Sep. 27, 2007

Related U.S. Application Data

(63) Continuation-in-part of application No. 11/686,638, filed on Mar. 15, 2007, now Pat. No. 7,424,922, which is a continuation-in-part of application No. 11/680,997, filed on Mar. 1, 2007, now Pat. No. 7,419,016, which is a continuation-in-part of application No. 11/673,872, filed on Feb. 12, 2007, now Pat. No. 7,484,576, which is a continuation-in-part of application No. 11/611,310, filed on Dec. 15, 2006, application No. 11/737,034, which is a continuation-in-part of application No. 11/278,935, filed on Apr. 6, 2006, now Pat. No. 7,426,968, which is a continuation-in-part of application No. 11/277,394, filed on Mar. 24, 2006, now Pat. No. 7,398,837, which is a continuation-in-part of application No. 11/277,380, filed on Mar. 24, 2006, now Pat. No. 7,337,858, which is a continuation-in-part of application No. 11/306,976, filed on Jan. 18, 2006, now Pat. No. 7,360,610, which is a continuation-in-part of application No. 11/306,307, filed on Dec. 22, 2005, now Pat. No. 7,225,886, which is a continuation-in-part of application No. 11/306,022, filed on Dec. 14, 2005, now Pat. No. 7,198,119, which is a continuation-in-part of application No. 11/164,391, filed on Nov. 21, 2005, now Pat. No. 7,270,196.

(51) Int. Cl.
*E21B 7/04* (2006.01)

(52) U.S. Cl. ..... 175/61; 175/73

(58) Field of Classification Search ..... 175/73, 175/61

See application file for complete search history.

(56) References Cited

U.S. PATENT DOCUMENTS

| | | | | |
|---|---|---|---|---|
| 4,637,479 | A * | 1/1987 | Leising | 175/26 |
| 4,836,301 | A * | 6/1989 | Van Dongen et al. | 175/61 |
| 4,991,667 | A * | 2/1991 | Wilkes et al. | 175/61 |
| 5,314,030 | A * | 5/1994 | Peterson et al. | 175/26 |
| 5,553,678 | A * | 9/1996 | Barr et al. | 175/73 |
| 6,089,332 | A * | 7/2000 | Barr et al. | 175/45 |

* cited by examiner

*Primary Examiner*—Hoang Dang
(74) *Attorney, Agent, or Firm*—Tyson J. Wilde

(57) ABSTRACT

In one aspect of the invention a drill string has a rotary valve disposed within its bore. The valve has a first disc attached to a driving mechanism and a second disc axially aligned with and contacting the first disc along a flat surface. Each disc has a port adapted to align with each other periodically when the discs rotate relative to one another. The aligned ports are adapted to direct fluid to at least one nozzle disposed in a working face of a drill bit of the drill string.

19 Claims, 8 Drawing Sheets

ROTARY VALVE FOR STEERING A DRILL STRING

CROSS REFERENCE TO RELATED APPLICATIONS

This patent application is a continuation-in-part of U.S. patent application Ser. No. 11/686,638 filed on Mar. 15, 2007, now U.S. Pat. No. 7,424,922, and entitled Rotary Valve for a Jack Hammer. U.S. patent application Ser. No. 11/686,638 is a continuation-in-part of U.S. patent application Ser. No. 11/680,997 filed on Mar. 1, 2007, now U.S. Pat. No. 7,419,016, and entitled Bi-center Drill Bit. U.S. patent application Ser. No. 11/680,997 is a continuation-in-part of U.S. patent application Ser. No. 11/673,872 filed on Feb. 12, 2007, now U.S. Pat. No. 7,484,576, and entitled Jack Element in Communication with an Electric Motor and/or generator. U.S. patent application Ser. No. 11/673,872 is a continuation in-part of U.S. patent application Ser. No. 11/611,310 filed on Dec. 15, 2006 and which is entitled System for Steering a Drill String. This patent application is also a continuation in-part of U.S. patent application Ser. No. 11/278,935 filed on Apr. 6, 2006, now U.S. Pat. No. 7,426,968, and which is entitled Drill Bit Assembly with a Probe. U.S. patent application Ser. No. 11/278,935 is a continuation in-part of U.S. patent application Ser. No. 11/277,394 which filed on Mar. 24, 2006, now U.S. Pat. No. 7,398,837, and entitled Drill Bit Assembly with a Logging Device. U.S. patent application Ser. No. 11/277,394 is a continuation in-part of U.S. patent application Ser. No. 11/277,380 also filed on Mar. 24, 2006, now U.S. Pat. No. 7,337,858, and entitled A Drill Bit Assembly Adapted to Provide Power Downhole. U.S. patent application Ser. No. 11/277,380 is a continuation in-part of U.S. patent application Ser. No. 11/306,976 which was filed on Jan. 18, 2006, now U.S. Pat. No. 7,360,610, and entitled "Drill Bit Assembly for Directional Drilling." U.S. patent application Ser. No. 11/306,976 is a continuation-in-part of 11/306,307 filed on Dec. 22, 2005, now U.S. Pat. No. 7,225,886, entitled Drill Bit Assembly with an Indenting Member. U.S. patent application Ser. No. 11/306,307 is a continuation in-part of U.S. patent application Ser. No. 11/306,022 filed on Dec. 14, 2005, now U.S. Pat. No. 7,198,119, entitled Hydraulic Drill Bit Assembly. U.S. patent application Ser. No. 11/306,022 is a continuation-in-part of U.S. patent application Ser. No. 11/164,391 filed on Nov. 21, 2005, now U.S. Pat. No. 7,270,196, which is entitled Drill Bit Assembly. All of these applications are herein incorporated by reference in their entirety.

BACKGROUND OF THE INVENTION

This invention relates to steering systems, specifically steering systems for use in oil, gas, geothermal, and/or horizontal drilling. The ability to accurately adjust the direction of drilling in downhole applications is desirable to direct the borehole toward specific targets. A number of steering systems have been devised for this purpose.

One such system is disclosed in U.S. Pat. No. 6,089,332 to Barr, et al. is herein incorporated by reference for all that it contains. The '332 patent discloses a steerable rotary drilling system having a bottom hole assembly which includes, in addition to the drill bit, a modulated bias unit and a control unit, the bias unit comprising a number of hydraulic actuators around the periphery of the unit, each having a movable thrust member which is hydraulically displaceable outwardly for engagement with the formation of the borehole being drilled. Each actuator may be connected, through a control valve, to a source of drilling fluid under pressure and the operation of the valve is controlled by the control unit so as to modulate the fluid pressure supplied to the actuators as the bias unit rotates. If the control valve is operated in synchronism with rotation of the bias unit the thrust members impart a lateral bias to the bias unit, and hence to the drill bit, to control the direction of drilling. Pulses transmitted through the drilling fluid as a result of operation of the bias unit are detected and interpreted at the surface, or at a different location downhole, to obtain information regarding the operation of the bias unit or other parts of the bottom-hole assembly. Data signals from downhole sensors may be arranged to modify the control and operation of the bias unit in such manner that the data is encoded as pulses generated in the drilling fluid by the bias unit.

BRIEF SUMMARY OF THE INVENTION

In one aspect of the invention a drill string has a rotary valve disposed within its bore. The valve has a first disc attached to a driving mechanism and a second disc axially aligned with and contacting the first disc along a flat surface. Each disc has a port adapted to align with each other periodically when the discs rotate relative to one another. The aligned ports are adapted to direct fluid to at least one nozzle disposed in a working face of a drill bit of the drill string.

In some embodiments, the fluid passed through the nozzle may be adapted to steer the drill string. The driving mechanism may be a turbine, a generator, a jack element, or a motor. The second disc may be fixed to a bore wall of the drill string or to a jack element. Fluid ports in the first and second discs may align so that fluid passes through into at least one nozzle. The angular velocity of the first disc and/or the second disc may be adjusted such that a desired amount of fluid passes through the nozzle at a given frequency.

A jack element may be substantially coaxial with an axis of rotation and may be disposed in the bore of the drill string. The jack element may also have a distal end extending beyond the working face of the drill bit. The jack element and the driving mechanism may rotate opposite each other. The jack element may be adapted to be stationary with respect to a formation and the drill bit is adapted to rotate around the jack element. A portion of the nozzle may be disposed around the jack element.

In some embodiments, a plurality of fluid ports may be formed in the second disc and may direct fluid to a plurality of nozzles. The nozzles may be disposed in the working face of the drill bit such that the fluid that passes through the nozzles may be used for cooling elements on the working face. The plurality of nozzles may be positioned at different angles with respect to a central axis of the drill bit. This may be beneficial in that a fluid pulse may contact the formation at different angles in order to selectively steer the drill string in different angles. A portion of the drilling fluid may be passed through the fluid ports of the first and second discs. Also, a portion of the fluid may bypass the rotary valve such that it is directed to a bore in the drill bit.

The flat surface between the first and second discs may comprise a material selected from the group consisting of chromium, tungsten, tantalum, niobium, titanium, molybdenum, carbide, natural diamond, polycrystalline diamond, vapor deposited diamond, cubic boron nitride, TiN, AlNi, AlTiNi, TiAlN, CrN/CrC/(Mo, W)S2, TiN/TiCN, AlTiN/MoS2, TiAlN, ZrN, diamond impregnated carbide diamond impregnated matrix, silicon bounded diamond, and/or combinations thereof. In some embodiments, the rotary valve may be disposed within the drill bit. The driving mechanism may operate at different speeds, which may be controlled by a closed loop system. The rotary valve may also be in communication with a telemetry system. It may also be beneficial to turn the rotary valve off and on so that the drill string may drill in a straight line or at a desired angle. A rotor may connect the first disc to the driving mechanism.

In another aspect of the invention a method has steps for steering a drill string through a formation with a drill string having a rotary valve disposed within its bore. The valve has a first disc attached to a driving mechanism and a second disc axially aligned with and contacting the first disc along a flat surface.

When fluid is passed through the bore from the surface, a portion of the fluid is selectively passed through ports formed in each of the discs into a nozzle disposed in a drill bit by rotating the discs relative to another by the driving mechanism such that the ports periodically align. A fluid pulse is formed by the aligning of the ports against the formation. The drill bit is steered by directing the fluid pulse against the formation in a selected azimuth proximate the drill bit so that the formation is eroded along the selected azimuth. Thus, the drill bit may drill in the direction of the selected azimuth.

DETAILED DESCRIPTION OF THE INVENTION AND THE PREFERRED EMBODIMENT

Figure 1:
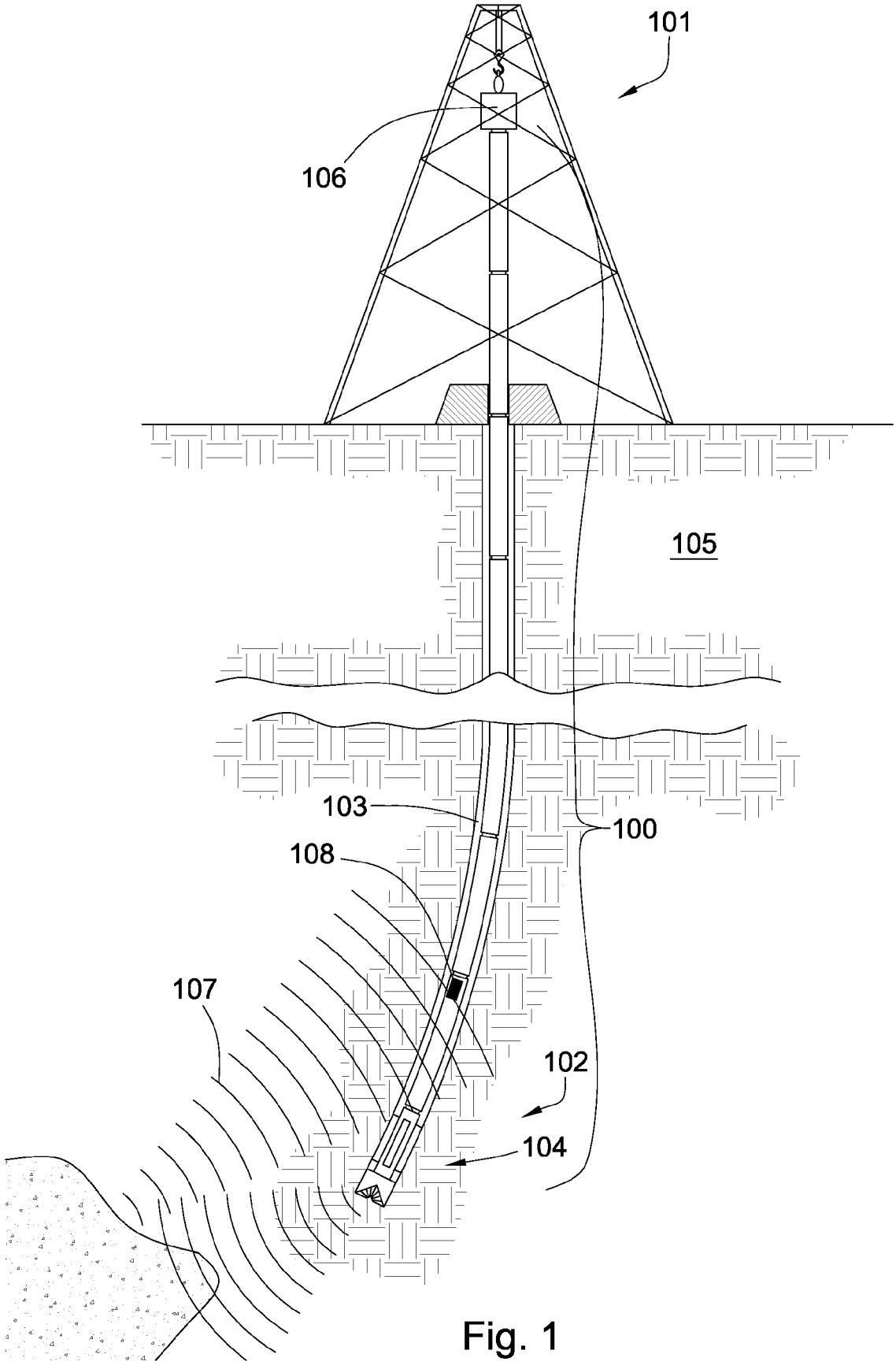
FIG. 1 is a perspective diagram of an embodiment of a drill string suspended in a borehole.

FIG. 1 is a perspective diagram of an embodiment of a drill string 100 suspended by a derrick 101. A bottom-hole assembly 102 is located at the bottom of a bore hole 103 and comprises a drill bit 104. As the drill bit 104 rotates downhole the drill string 100 advances farther into the earth. The drill bit 104 may be steered in a preferred direction. The drill string 100 may penetrate soft or hard subterranean formations 105. The bottom-hole assembly 102 and/or downhole components may comprise data acquisition devices which may gather data. The data may be sent to the surface via a transmission system to a data swivel 106. The data swivel 106 may send the data to the surface equipment. Further, the surface equipment may send data and/or power to downhole tools and/or the bottom-hole assembly 102. The drill string 100 may produce acoustic signals 107 during a drilling operation. A sensor 108 may be disposed on the surface of the drill string 100; the sensor being adapted to receive acoustic signals 107 returned from the formation 105. This may be useful in determining the density or porosity of a formation 105. U.S. Pat. No. 6,670,880 which is herein incorporated by reference for all that it contains, discloses a telemetry system that may be compatible with the present invention; however, other forms of telemetry may also be compatible such as systems that include mud pulse systems, electromagnetic waves, radio waves, wired pipe, and/or short hop. In some embodiments, no telemetry system is incorporated into the drill string.

Figure 2:
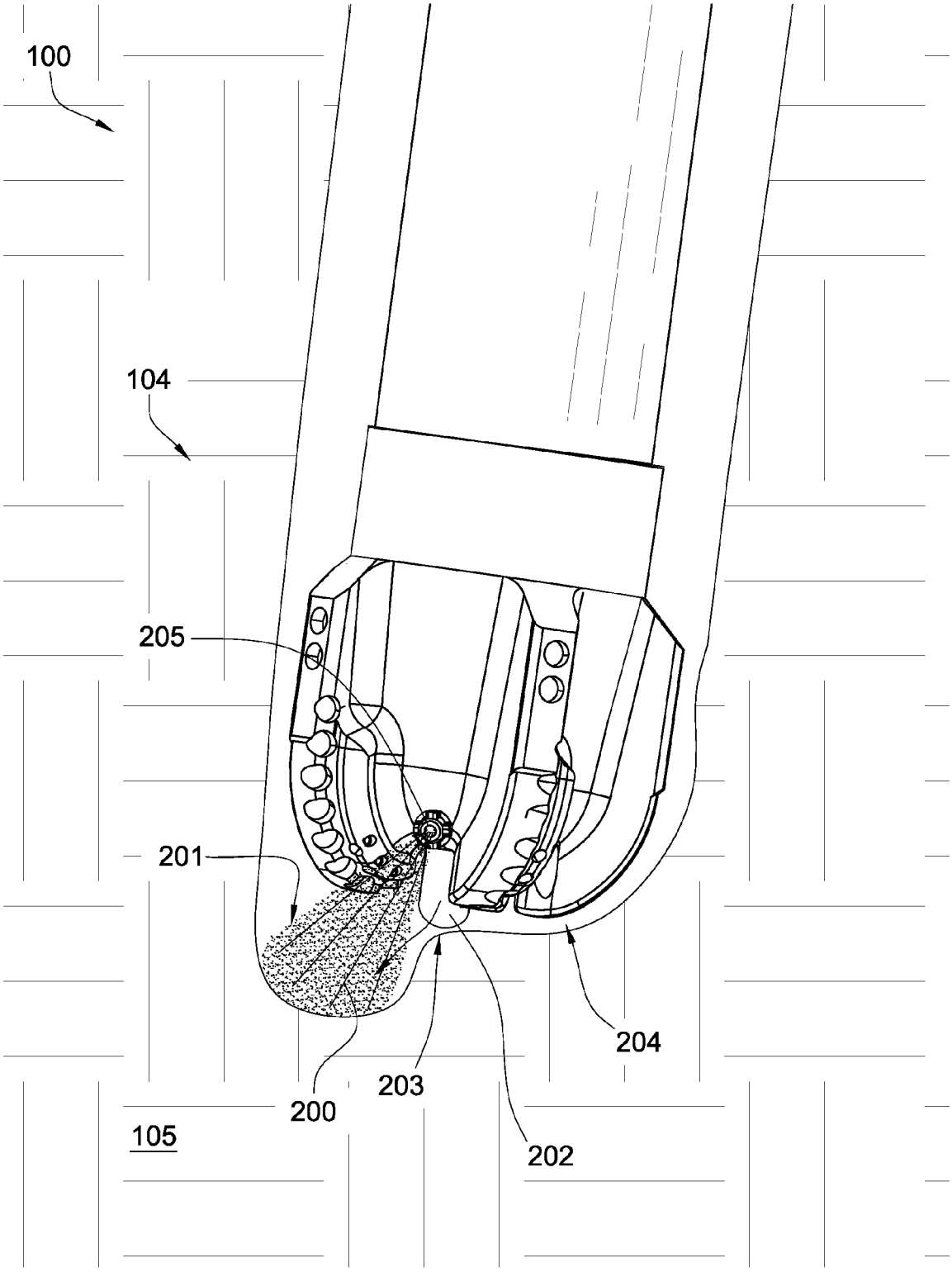
FIG. 2 is a perspective diagram of an embodiment of a drill bit.

FIG. 2 is a perspective diagram of an embodiment of a drill string 100 in a bore hole 103. In the preferred embodiment a rotary valve disposed within the drill string 100 may operate such that fluid passed through it forms a fluid pulse 200 against the formation 105 in a selected azimuth 201 proximate the drill bit 104. As the fluid pulse 200 erodes the formation 105 along the selected azimuth 201, the drill string may drill along the selected azimuth 201. A nozzle 205 may be disposed in a working face 204 of the drill bit 104 of the drill string 100 which is adapted to guide the fluid pulse 200 along the selected azimuth 201 and may be disposed proximate a jack element. In this embodiment, a jack element 202 may be disposed within the drill string 100 and may have a distal end 203 extending beyond the working face 204 of the drill bit 104. The jack element 202 may help to stabilize the drill string 100 during a drilling operation. The jack element 202 may be guided by the pulsed fluid by eroding the formation proximate the jack element along the selected azimuth thereby creating a path of least resistance for the distal end of the jack element to follow and thereby steering the entire drill string 100 along the selected azimuth 201.

Figure 3:
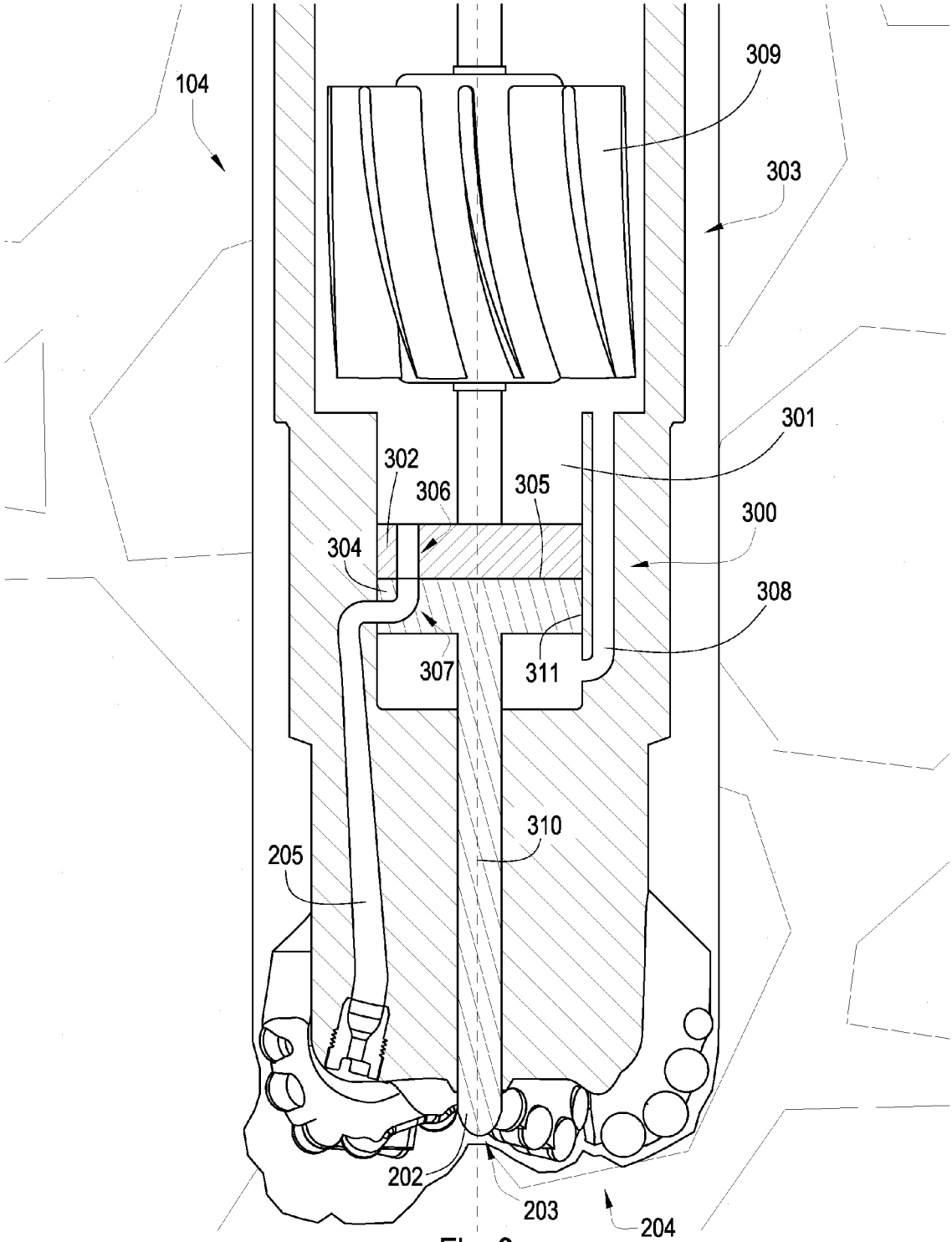
FIG. 3 is a cross-sectional diagram of another embodiment of a drill bit.

FIG. 3 shows a cross-sectional diagram of an embodiment of a drill bit 104. In the preferred embodiment, a rotary valve 300 may be disposed within a bore 301 of the drill bit 104 comprising a first disc 302 attached to a driving mechanism 303 and a second disc 304 axially aligned with and contacting the first disc 302 along a flat surface 305. A rotor may connect the first disc to the driving mechanism 303. The first disc 302 may comprise a fluid port 306 and the second disc 304 may also comprise a fluid port 307. The fluid ports 306, 307 may be adapted to align with each other periodically when the discs 302, 304, rotate relative to one another during a drilling operation. The aligned ports 306, 307, may be adapted to direct fluid to at least one nozzle 205 disposed in a working face 204 of the drill bit 104. The fluid passed through the nozzle 205 may be adapted to steer the drill string. In some embodiments, the fluid ports may direct fluid to a plurality of nozzles. A portion of fluid may be passed through the rotary valve 300. Another portion of the fluid may bypass the valve 300 through a fluid passageway 308. In some embodiments, the fluid passageway may direct the fluid to a plurality of nozzles.

The driving mechanism 303 may be a turbine, a generator, a jack element, or a motor. In this embodiment, the driving mechanism 303 is a turbine 309. The driving mechanism 303 may operate at different speeds. This may be beneficial such that the amount of fluid passing through the valve 300 into the nozzle 205 may be regulated and thus, steering may be controlled. Also, the direction of steering may be controlled by adjusting the speed of the driving mechanism 303. In some drilling operations, it may be desired that the drill string 100 drills in a straight line for a time. In such applications, the rotary valve 300 may be turned off and on. The rotary valve 300 may be turned off by rotating the discs 302, 304, at the same angular velocity so that no fluid passes through the rotary valve. Also, the discs 302, 304, may not rotate so that the fluid ports 306, 307, are not aligned, thus turning off the valve. Fluid passing into the bore 301 from the surface may rotate the turbine 309, thus rotating the first disc 302. A jack element 202 substantially coaxial with an axis of rotation 310 may be disposed in the bore 301 of the drill string. The jack element may have a distal end 203 extending beyond the working face 204 of the drill bit 104. In this embodiment, the second disc 304 may be fixed to the jack element 202. In other embodiments, the second disc may be fixed to a bore wall 311 of the drill string. The jack element 202 and the driving mechanism 303 may rotate opposite each other so that the discs 302, 304 rotate opposite each other. In some embodiments, the jack element 202 may be stationary with respect to a formation and the drill bit 104 may rotate around the jack element 202.

Figure 5:
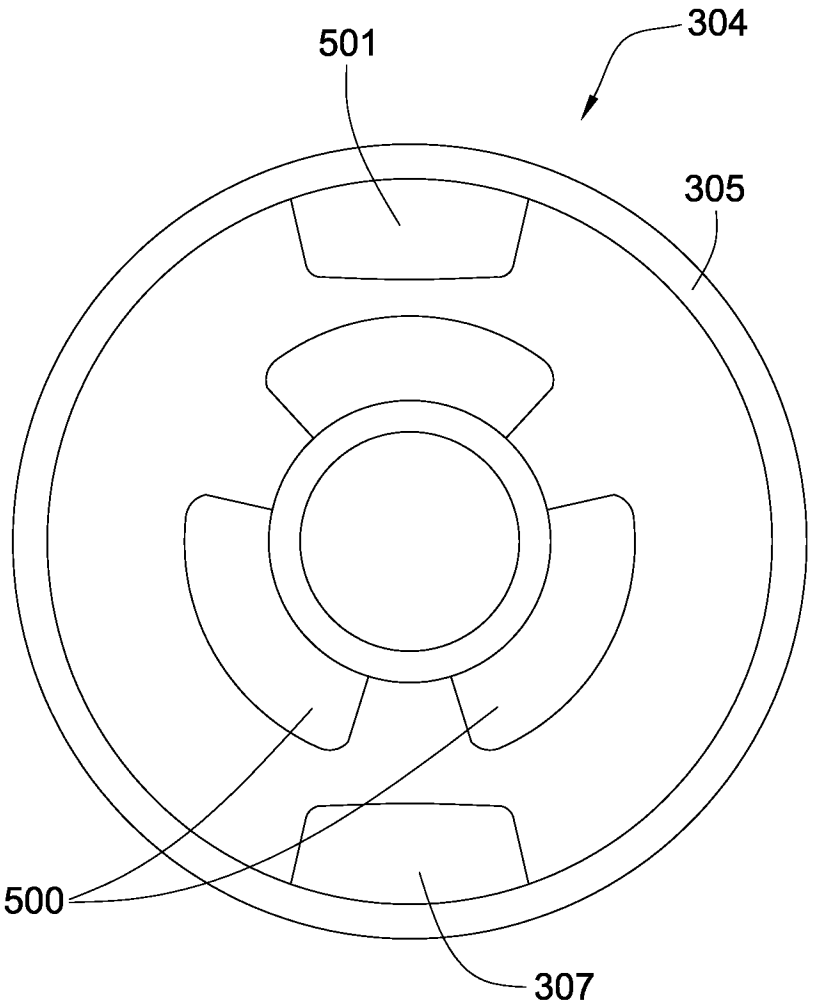
FIG. 5 is a sectional diagram of another embodiment of a valve in a drill string component.
Figure 4:
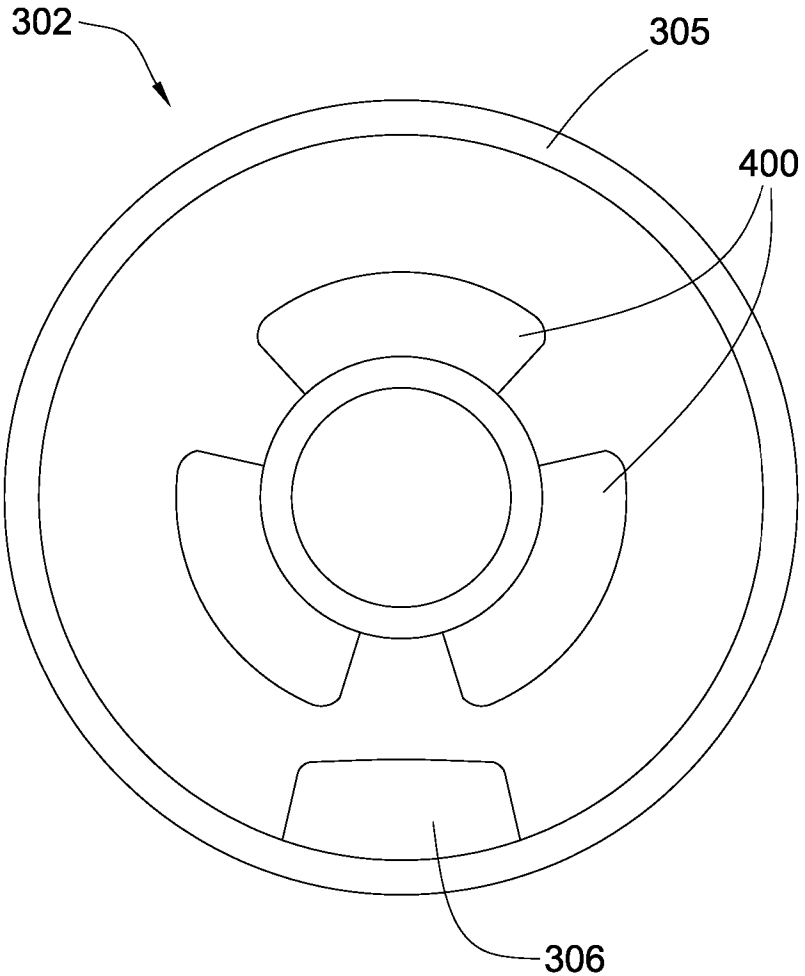
FIG. 4 is a sectional diagram of an embodiment of a valve in a drill string component.

FIGS. 4 and 5 are sectional diagrams of a first disc 302 and a second disc 304 of a rotary valve. The discs 302, 304, may be axially aligned and may contact each other along a flat surface 305. The flat surface 305 may comprise a material selected from the group consisting of chromium, tungsten, tantalum, niobium, titanium, molybdenum, carbide, natural diamond, polycrystalline diamond, vapor deposited diamond, cubic boron nitride, TiN, AlNi, AlTiNi, TiAlN, CrN/CrC/(Mo, W)S2, TiN/TiCN, AlTiN/MoS2, TiAlN, ZrN, diamond impregnated carbide, diamond impregnated matrix, silicon bounded diamond, and/or combinations thereof. The first disc 302 may have a fluid port 306 and the second disc may have a fluid port 307, wherein as the discs 302, 304, rotate relative to one another, the fluid ports 306, 307, periodically align such that fluid may pass through the valve. The fluid passing through the valve may form a fluid pulse that may be used for steering the drill string. A portion of the fluid may pass through the fluid ports 306, 307, whereas another portion of the drilling fluid may bypass the rotary valve.

The discs 302, 304, may also comprise fluid ports 400, 500, that continuously allow fluid to pass through the rotary valve. Fluid ports 400, 500, may direct the fluid to a plurality of nozzles disposed in the drill bit. Another fluid port 501 may be disposed in the second disc 304, the fluid port 501 being adapted to direct fluid to a plurality of nozzles. As the two discs 302, 304 rotate opposite each other the fluid ports 307, 501, of the second disc 304 may align with the fluid port 306 disposed in the first disc 302 at different times so that the fluid may be periodically directed to various nozzles.

Figure 6:
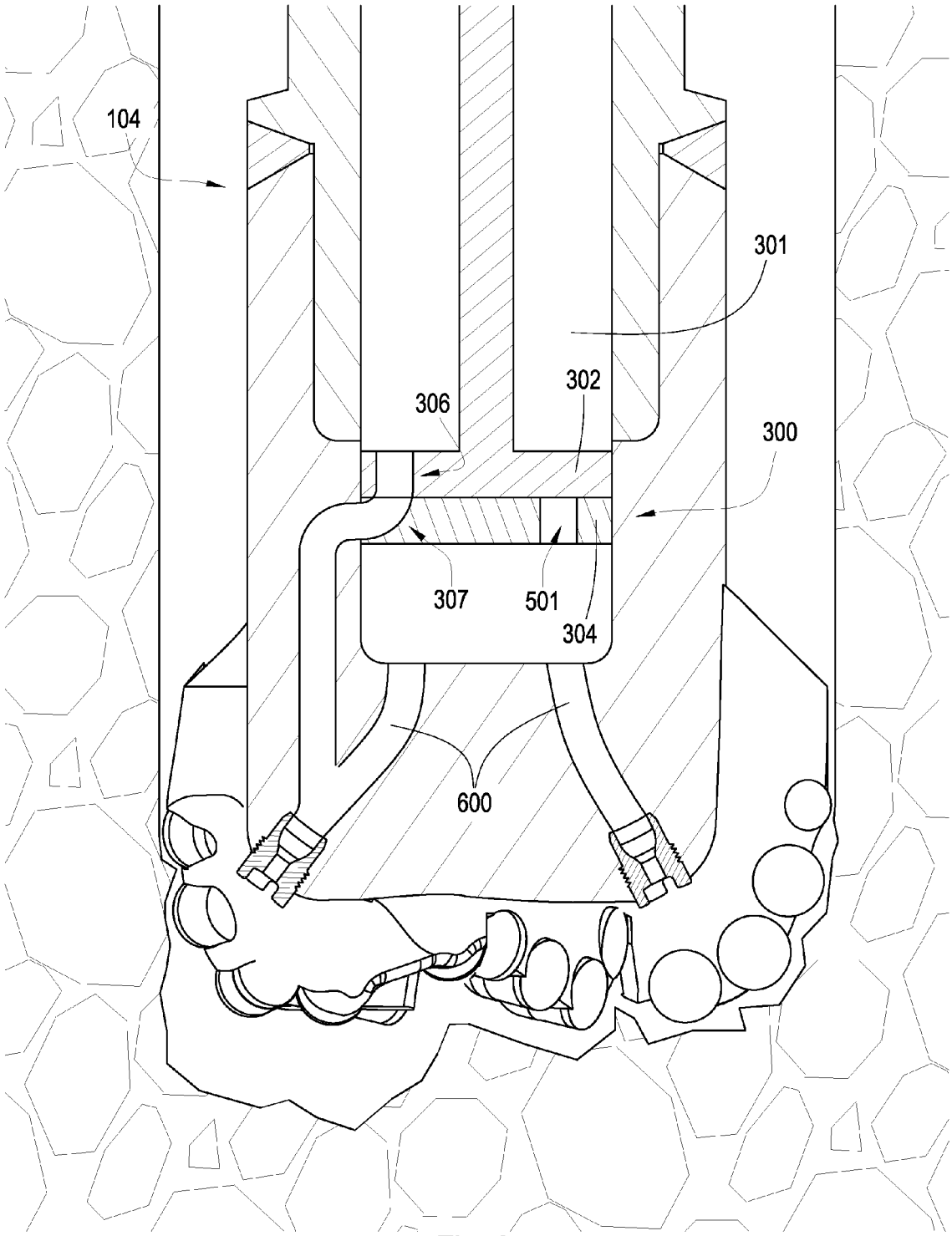
FIG. 6 is a cross-sectional diagram of another embodiment of a drill bit.

In the embodiment of FIG. 6, a drill bit 104 has a rotary valve 300 disposed within its bore 301. The rotary valve 300 may have fluid ports 306, 307 disposed in discs 302, 304, such that when the fluid ports align, fluid may pass through the rotary valve 300 to a nozzle 205 disposed in the drill bit 104. A plurality of fluid ports 501 may also be disposed in the second disc 304 such that when the fluid ports 306, 501, align fluid may be directed to a plurality of nozzles 600. The plurality of nozzles 600 may be positioned at different angles with respect to the axis of rotation 310 of the drill bit 104. This may help to steer the drill string 100 at different angles in the direction of the preferred azimuth.

Figure 7:
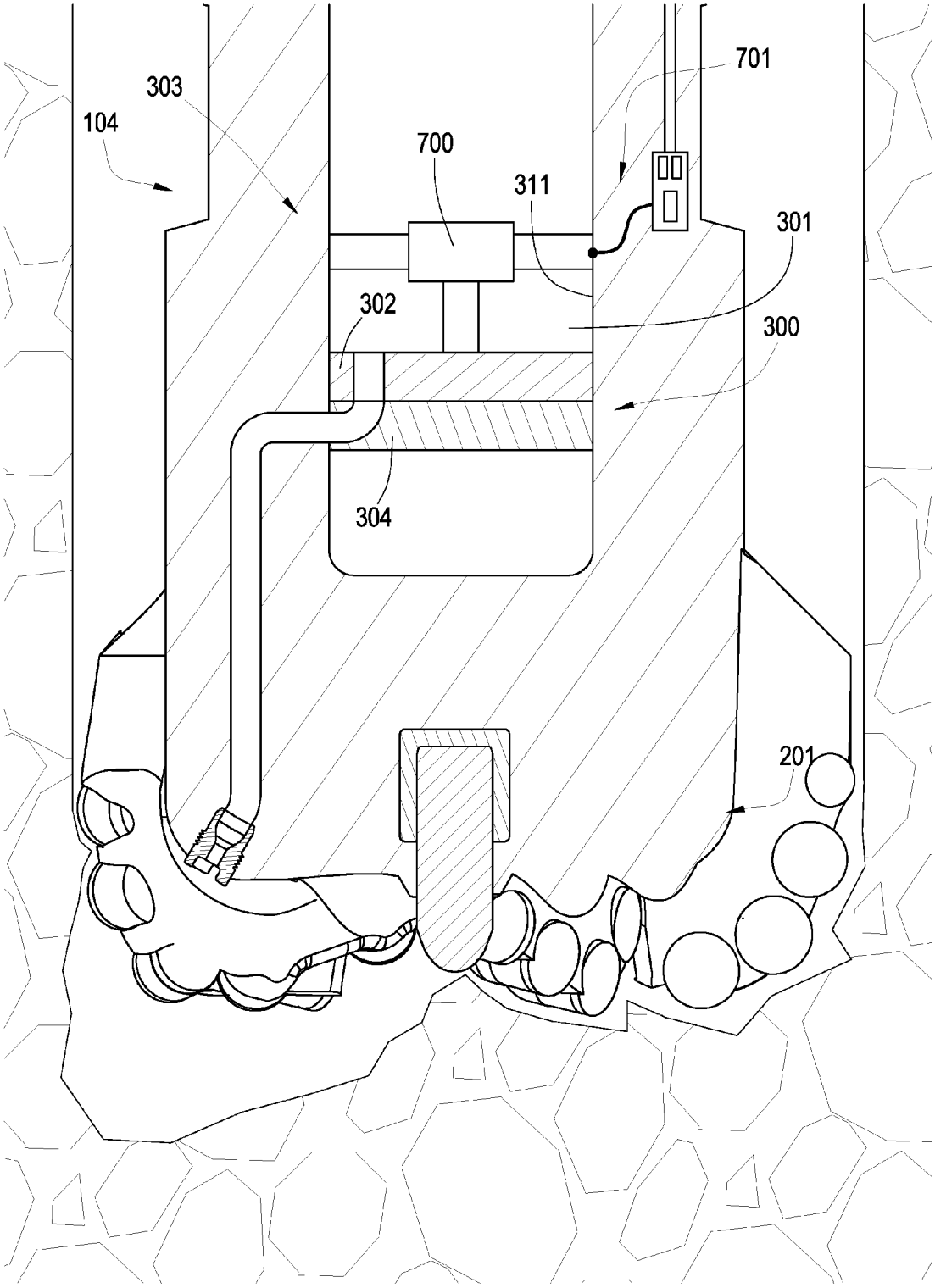
FIG. 7 is a cross-sectional diagram of another embodiment of a drill bit.

Referring now to FIG. 7, a drill bit 104 may comprise a rotary valve 300 disposed in the bore 301 of the drill string. A first disc 302 of the rotary valve 300 may be attached to a driving mechanism 303. In this embodiment, the driving mechanism 303 is an electric motor 700. The electric motor 700 may also be fixed to a bore wall 311 of the drill string. The second disc 304 of the rotary valve 300 may be fixed to the bore wall 311 so that the drill string rotates the disc 304 during a drilling operation In some applications, it may be desirable to drill in a straight line. In such applications, the motor 700 may be turned off so that the first disc 302 and the second disc 304 rotate together at the same angular velocity of the drill string. The drill string may rotate the first and second discs 302, 304. Fluid may or may not pass through the rotary valve 300 while the electric motor 700 is turned off, wherein fluid passing through the rotary valve 300 may flow at a continuous rate.

A telemetry system 701 may be connected to the driving mechanism 303. The telemetry system 701 may comprise electrical circuitry 702 and may be in communication with the rotary valve 300 so that the rotation of the first disc 302 may be controlled by the telemetry system 701.

Figure 8:
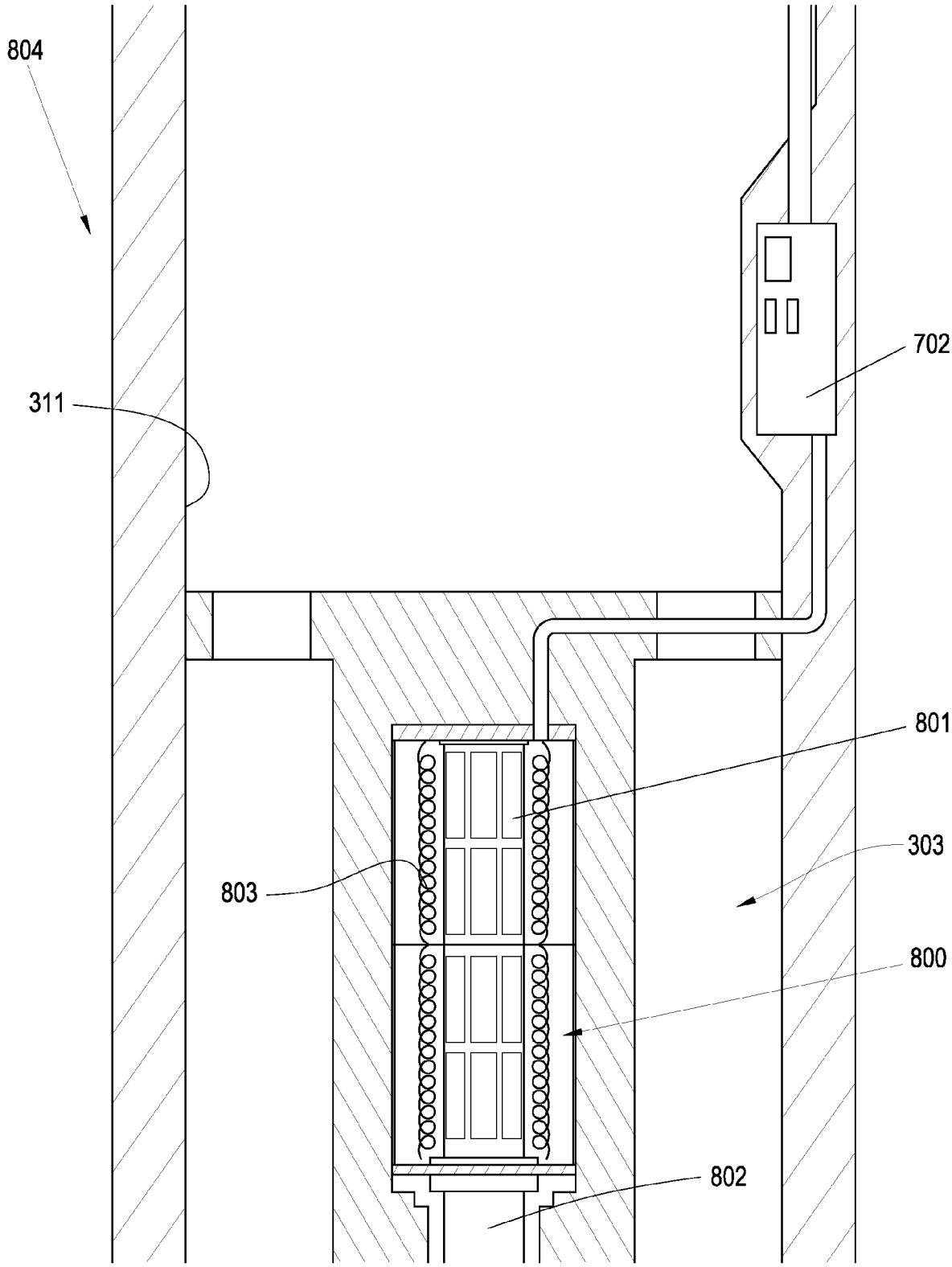
FIG. 8 is a cross-sectional diagram of a driving mechanism.

As shown in FIG. 8, the driving mechanism 303 may be an electric generator 800. One such generator 800 which may be used is the Astro 40 from AstroFlight, Inc. The generator 800 may comprise separate magnetic strips 801 disposed along the outside of a rotor 802 which magnetically interacts with a coil 803 as it rotates, producing a current in the electrically conductive coil 803. The magnetic strips are preferably made of samarium cobalt due to its high Curie temperature and high resistance to demagnetization. The coil 803 may be in communication with an electric load. When the load is applied, power is drawn from the generator 800, causing the turbine to slow its rotation, which thereby slows the rotation of the discs with respect to one another. The load may be a resistor, nichrome wires, coiled wires, electronics, or combinations thereof. The load may be applied and disconnected at a rate at least as fast as the rotational speed of the driving mechanism. There may be any number of generators used in combination. In embodiments where the driving mechanism is a valve or a hydraulic motor, a valve may control the amount of fluid that reaches the driving mechanism, which may also control the speed at which they rotate. The electrical generator may be in communication with the load through electrical circuitry 702. The electrical circuitry 702 may be disposed within the bore wall 311 of a component 804. The generator may be connected to the electrical circuitry 702 through a coaxial cable. The circuitry may be part of a closed-loop system. The electrical circuitry 702 may also comprise sensors for monitoring various aspects of the drilling, such as the rotational speed or orientation of the component with respect to the formation. Sensors may also measure the orientation of the generator 800 with respect to the component 804. The data collected from these sensors may be used to adjust the rotational speed of the turbine in order to control the fluid pulses.

The load may be in communication with the downhole telemetry system 701. Data collected from sensors or other electrical components downhole may be sent to the surface through the telemetry system 701. The data may be analyzed at the surface in order to monitor conditions downhole. Operators at the surface may use the data to alter the direction of drilling. Other types of telemetry systems may include mud pulse systems, electromagnetic wave systems, inductive systems, fiber optic systems, direct connect systems, wired pipe systems, or any combinations thereof. In some embodiments, the sensors may be part of a feed back loop which controls the logic controlling the load. In such embodiments, the drilling may be automated and electrical equipment may comprise sufficient intelligence to drill toward a desirable formation or to avoid potentially harsh drilling formations while keeping the drill string on the right trajectory.

Figure 9:
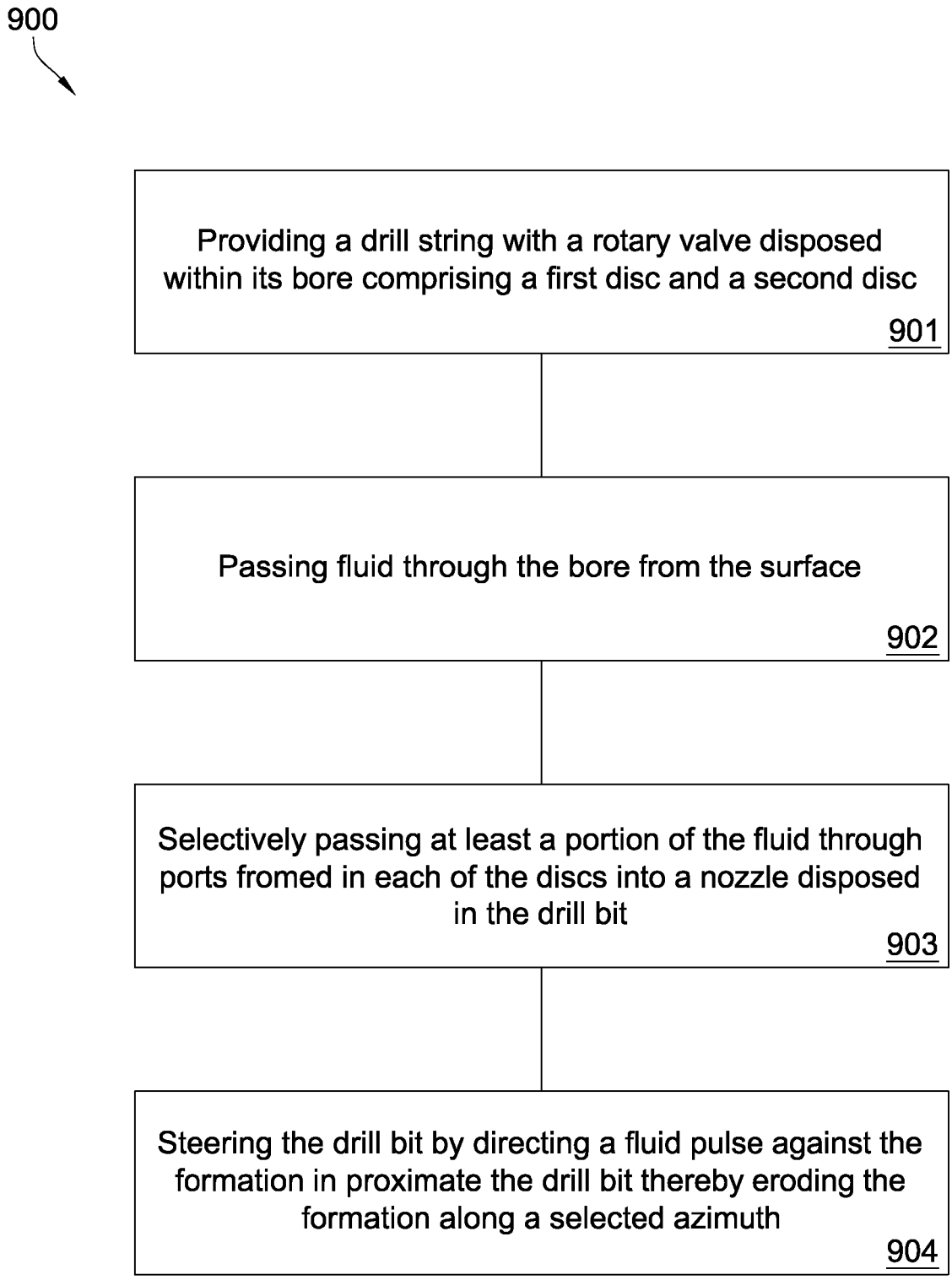
FIG. 9 is a diagram of an embodiment of a method for steering a drill string.

FIG. 9 is a diagram of an embodiment of a method 900 for steering a drill string. The method 900 includes providing 901 a drill string with a rotary valve disposed within its bore comprising a first disc and a second disc. The first disc may be attached to a driving mechanism and the second disc may be axially aligned with and contacting the first disc along a flat surface. The method also includes passing 902 fluid through the bore from the surface. Further the method 900 includes selectively passing 903 at least a portion of the fluid through ports formed in each of the discs into a nozzle disposed in the drill bit. Fluid may pass through the rotary valve when the discs are rotated relative to another by the driving mechanism such that the ports periodically align. The method also includes steering 904 the drill bit by directing a fluid pulse against the formation in proximate the drill bit thereby eroding the formation along a selected azimuth so that the drill string drills in a direction opposite the selected azimuth.

Whereas the present invention has been described in particular relation to the drawings attached hereto, it should be understood that other and further modifications apart from those shown or suggested herein, may be made within the scope and spirit of the present invention.

What is claimed is:

1. A drill string, comprising:

a rotary valve disposed within a bore of the drill string comprising a first disc attached to a driving mechanism and a second disc axially aligned with and contacting the first disc along a flat surface;

each disc comprises a port adapted to align with each other periodically when the discs rotate relative to one another;

wherein the aligned ports are adapted to direct fluid to at least one nozzle disposed in a working face of a drill bit of the drill string;

wherein a jack element substantially coaxial with an axis of rotation is disposed in the bore of the drill string and comprises a distal end extending beyond the working face of the drill bit.

2. The drill string of claim 1, wherein the fluid passed through the at least one nozzle is adapted to steer the drill string.

3. The drill string of claim 1, wherein the driving mechanism is a turbine, a generator, a jack element, or a motor.

4. The drill string of claim 1, wherein the second disc is fixed to a bore wall of the drill string or to a jack element.

5. The drill string of claim 1, wherein the jack element and the driving mechanism rotate opposite each other.

6. The drill string of claim 1, wherein the jack element is adapted to be stationary with respect to a formation and the drill bit is adapted to rotate around the jack element.

7. The drill string of claim 1, wherein the nozzle is adjacent to the jack element.

8. The drill string of claim 1, wherein a plurality of fluid ports are formed in the second disc.

9. The drill string of claim 8, wherein the fluid ports direct fluid to a plurality of nozzles.

10. The drill string of claim 9, wherein the plurality of nozzles are positioned at different angles with respect to the axis of rotation.

11. The drill string of claim 1, wherein a portion of the drilling fluid is passed through the fluid ports.

12. The drill string of claim 1, wherein the flat surface comprises a material selected from the group consisting of chromium, tungsten, tantalum, niobium, titanium, molybdenum, carbide, natural diamond, polycrystalline diamond, vapor deposited diamond, cubic boron nitride, TiN, AlNi, AlTiNi, TiAlN, CrN/CrC/(Mo, W)S2, TiN/TiCN, AlTiN/MoS2, TiAlN, ZrN, diamond impregnated carbide, diamond impregnated matrix, silicon bounded diamond, and/or combinations thereof.

13. The drill string of claim 1, wherein the rotary valve is disposed within the drill bit.

14. The drill string of claim 1, wherein the driving mechanism operates at different speeds.

15. The drill string of claim 1, wherein the speed of the driving mechanism is controlled by a closed loop system.

16. The drill string of claim 1, wherein the rotary valve is in communication with a telemetry system.

17. The drill string of claim 1, wherein a rotor connects the first disc to the driving mechanism.

18. A method for steering a drill string through a formation, comprising the steps of:

providing the drill string with a rotary valve disposed within its bore comprising a first disc attached to a driving mechanism and a second disc axially aligned with and contacting the first disc along a flat surface;

providing a drill bit with a jack element substantially coaxial with an axis of rotation and being disposed in the bore of the drill string and comprising a distal end extending beyond the working face of the drill bit;

passing fluid through the bore from the surface;

selectively passing at least a portion of the fluid through ports formed in each of the discs into a nozzle disposed in the drill bit by rotating the discs relative to another by the driving mechanism such that the ports periodically align;

steering the drill bit by directing a fluid pulse formed by the aligning of the ports against the formation in a selected azimuth proximate the drill bit thereby eroding the formation along the selected azimuth.

19. The method of claim 18, wherein the eroding of the formation occurs proximate a distal end of a jack element.

* * * * *